United States Patent [19]

Portman

[11] 4,273,374

[45] Jun. 16, 1981

[54] ANCHORING DEVICE FOR INTRAVENOUS BOTTLE HOLDER

[76] Inventor: Stanley J. Portman, 185 Essex St., Melrose, Mass. 02176

[21] Appl. No.: 787

[22] Filed: Jan. 3, 1979

[51] Int. Cl.[3] ..... A61G 3/00

[52] U.S. Cl. ..... 296/19; 5/503; 248/222.3; 403/349

[58] Field of Search ..... 296/19, 20; 248/222.3; 403/235, 246, 349; 5/60, 118, 503, 508

[56] References Cited

U.S. PATENT DOCUMENTS

| | | | |
|---|---|---|---|
| 2,470,524 | 5/1949 | Scudder | 5/503 |
| 3,005,656 | 10/1961 | Fulton | 296/19 |
| 3,137,470 | 6/1964 | Feldman | 5/503 |
| 3,337,880 | 8/1967 | Florek | 5/503 |
| 3,835,486 | 9/1974 | Benoit et al. | 5/503 |
| 3,918,554 | 11/1975 | Bourgrof et al. | 296/19 |

FOREIGN PATENT DOCUMENTS

| | | | |
|---|---|---|---|
| 16504 | of 1912 | United Kingdom | 403/349 |
| 126841 | 5/1959 | U.S.S.R. | 403/349 |

*Primary Examiner*—David M. Mitchell
*Assistant Examiner*—Ross Weaver
*Attorney, Agent, or Firm*—Weingarten, Maxham & Schurgin

[57] ABSTRACT

A device is disclosed for anchoring an upright pole or other supporting means used to support an intravenous bottle holder, particularly for use in an emergency vehicle, such as an ambulance. The anchoring device is particularly useful to secure the upper extremity of a pole to the vehicle inside roof surface, and in one embodiment of the device, a locking feature is provided with the anchoring device to prevent accidental disengagement of the pole and holder. The pole is typically mounted upon a platform, such as a cot used in emergency transport of patients, and with use of the invention, inconvenient and undesirable swaying of the pole and rotation of the holder is prevented, thereby minimizing a safety hazard to ambulance attendants and the patient.

8 Claims, 10 Drawing Figures

ANCHORING DEVICE FOR INTRAVENOUS BOTTLE HOLDER

BACKGROUND OF THE INVENTION

1. Field of the Invention

The invention relates to an improvement in emergency vehicle transport systems. More particularly, the invention relates to a device for anchoring the upper portion of a support pole mounted on a platform, such as a cot or stretcher for transporting a patient in an emergency vehicle. It is possible with use of the invention to avoid swaying or disruptive motion of the pole when used to support an intravenous bottle holder.

2. Description of the Prior Art

Holders for intravenous supply bottles are known in the prior art, such as shown in the Richmond, Alexander and Krasnoff patents listed below. Raia shows a device including a telescopic mounting stand. Moreover, anchoring devices or ceiling support devices, such as for a light fixture or chandelier are known in the prior art, such as by Cochran and Corey. These and the the following patents are illustrative of the state of the art with regard to the field of the invention:

U.S. Pat. No. 917,847—Apr. 13, 1909—Corey
U.S. Pat. No. 1,182,351—May 9, 1916—Cochran
U.S. Pat. No. 2,004,786—June 11, 1935—Gaus
U.S. Pat. No. 2,957,187—Oct. 25, 1960—Raia
U.S. Pat. No. 3,248,120—Apr. 26, 1966—Volpe
U.S. Pat. No. 3,318,457—May 9, 1967—Krasnoff
U.S. Pat. No. 3,709,372—Jan. 9, 1973—Alexander
U.S. Pat. No. 4,005,844—Feb. 1, 1977—Richmond.

None of the patents listed above discloses a device to anchor the upper end of a cot-mounted support for intravenous bottles to the ceiling or roof of an emergency vehicle. Inasmuch as a need and demand for such a device exists, the present invention fulfills such a need. Moreover, none of the patents above discloses a locking feature for removably attaching the upwardly projecting support pole and used to attach a bottle holder in a secure fashion.

SUMMARY OF THE INVENTION

It is a principal object of the invention to anchor an upwardly projecting support pole mounted on a support platform of an emergency vehicle to prevent swaying motion or other instability of the bottles attached thereto during use.

Another object of the invention is to provide an anchoring device permanently affixed to the inside roof of the vehicle into which the support pole can be fitted for securing the upper end thereof easily, expeditiously under hurried circumstances of usage, and without the necessity for separate manipulative operations, such as screwing, bolting, clamping, or the like.

Still another object of the invention is to provide the anchoring device in which the support pole can be secured with a locking action which is easily effected under hurried emergency conditions and prevents accidental disengagement of the support pole tip from the anchoring device during use.

A further object of the invention is to provide such a locking feature which is relatively easily disengaged by manipulation when required after a period of use.

These and further objects are achieved with use of a generally disk-shaped anchoring device attached by suitable mechanical means, such as metal screws, bolts, or the like, to the inside vehicle roof surface. The device is provided with a recess to receive the upwardly projecting support pole, the support pole including a pair of oppositely laterally extending arms from which the bottles are dependingly attached. The anchoring device is provided with a diametric slot to accommodate the arms, in which configuration, the pole is prevented from swaying and the arms are substantially prevented from twisting or rotating.

In an alternative embodiment of the device wherein a locking feature is provided, a locking platform is provided by undercutting from the diametric slot so that the radial arms are lifted upwardly through the slot, rotated and permitted to drop into the locked configuration. Reversal of this procedure then is used to disengage the support pole after a period of use.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
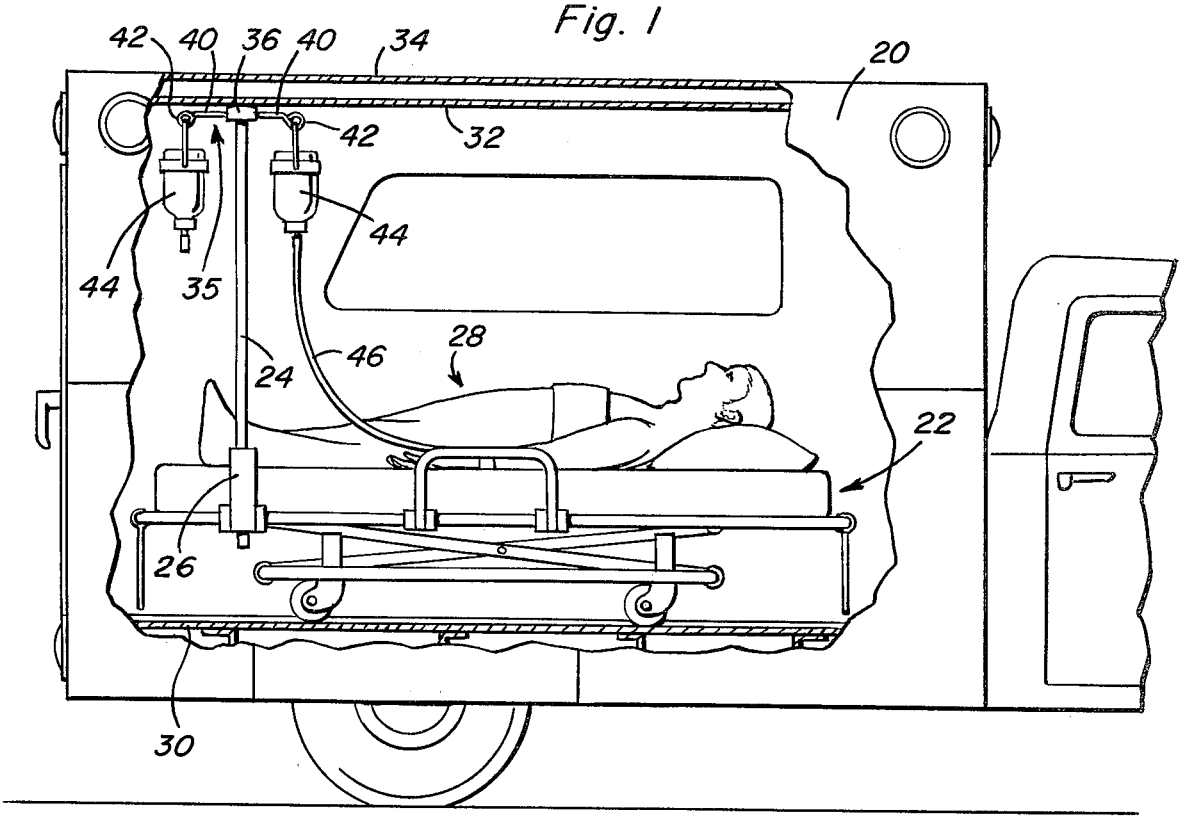
FIG. 1 is a side elevational view of an emergency vehicle, partially cut away to show in section a support platform constructed for emergency transport of a patient. The support pole is provided with a holder comprising two arms from which are suspended intravenous bottles, the anchoring device of the present invention being shown in use to prevent swaying of the pole and twisting of the bottle holder arms.

In FIG. 1, an ambulance is depicted, designated generally by the numeral 20 and including a patient support structure 22. A support pole 24 is attached by mount 26 to patient support structure 22, which is shown in FIG. 1 carrying patient 28. Ambulance 20 is provided with a floor 30 and an inside roof 32, as well as outside roof 34. Anchoring device 36, which forms the first embodiment of the present invention, is attached to inside roof 32 in the manner and for the purpose hereinafter described. Support pole 24 projects upwardly from mount 26 and includes a bottle holder 38 near its upper distal end. The bottle holder 38 comprises arms 40, which terminate in loops 42 for supporting one or a pair of bottles 44, which typically are used to supply whole blood, blood plasma, or the like, and one of which is shown in FIG. 1 with connecting tube 46 for delivery of the contents of the bottle to which it is attached to patient 28. It is readily apparent that during emergency transport of patient 28 in ambulance 20, there will be frequent instances of mechanical stress on the contents of ambulance 20, including support pole 24, bottle holder 38 and bottles 44. Such lateral forces would be expected to create swaying of pole 24 and bottles 44 as well as rotation of arms 40 and bottles 44, thereby interfering with the activity of ambulance attendants within ambulance 20, and posing a potentially serious health hazard to patient 28 as well. The devices of the present invention are designed to obviate these problems by eliminating or minimizing such swaying of pole 24 or rotation of support 38.

Figure 2:
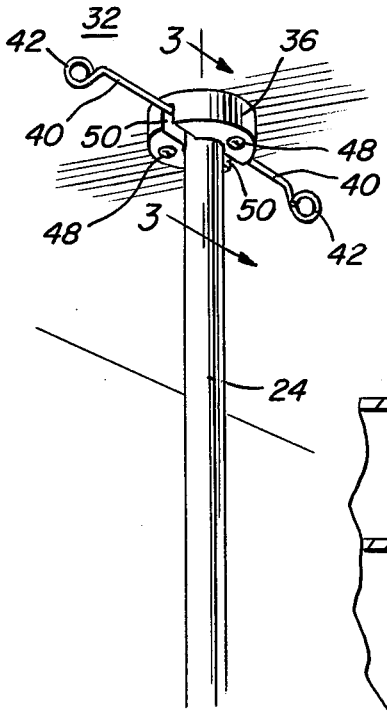
FIG. 2 is a perspective view of the anchoring device from inside the vehicle to which it is affixed, along with a support pole and holder arms in anchoring engagement with the device of the present invention.

FIG. 2 shows in greater enlarged detail the first form of anchoring device 36 as mounted on inside roof 32 by mounting screws 48. Although intravenous bottles 44 are not shown in FIG. 2, their mode of attachment to loops 42 is apparent from FIG. 1. FIG. 2 also illustrates diametric slot 50 within which arms 40 are placed.

Figure 3:
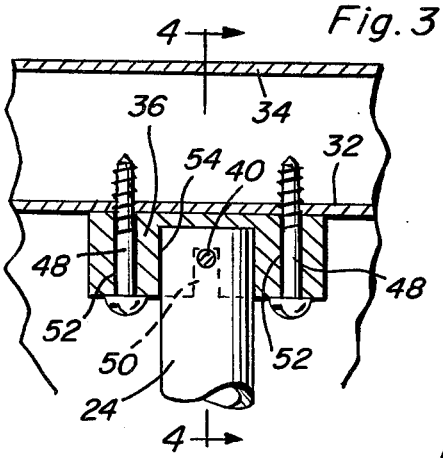
FIG. 3 is an enlarged sectional view of the device shown in FIG. 2, taken substantially upon a plane passing along section line 3—3 of FIG. 2, showing details of the mounting of the device on the vehicle roof, shown fragmentarily in FIG. 3.
Figure 5:
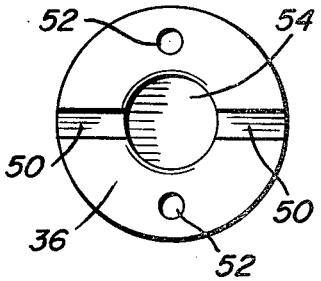
FIG. 5 is a bottom plan view of the device of the present invention.
Figure 4:
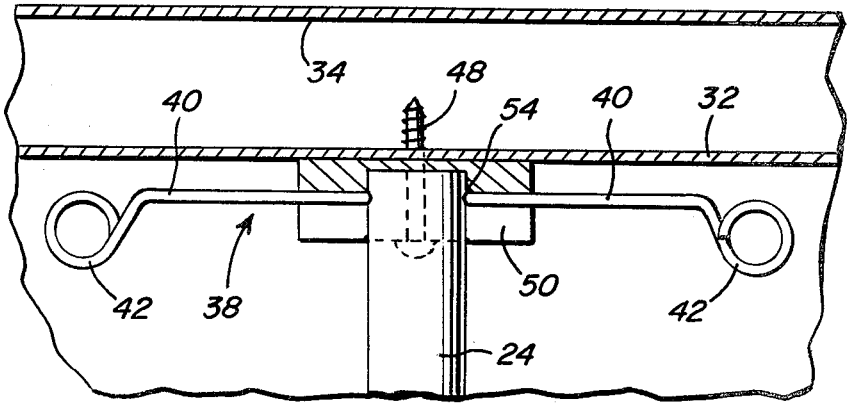
FIG. 4 is a sectional view of the device of the present invention, taken substantially upon a plane passing along section line 4—4 of FIG. 3.

FIG. 3 shows these same features in greater detail, illustrating particularly the mounting holes in anchoring device 36 to which mounting screws 48 are placed. Recess 54 in device 36 is provided with a diameter slightly greater than that of mounting pole 24 to facilitate insertion thereof. FIGS. 4 and 5 further illustrate the first embodiment of the invention from different directions than FIG. 3.

Figure 6:
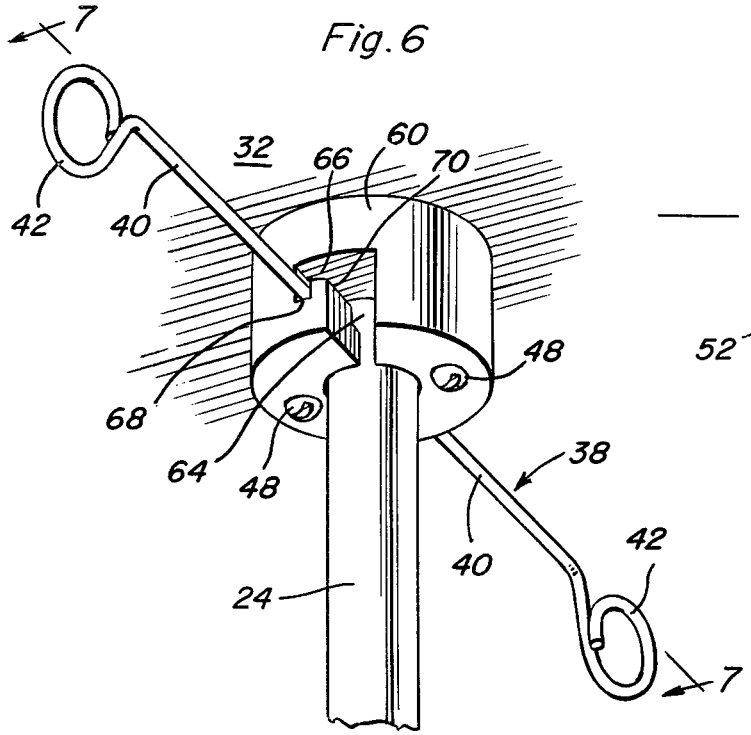
FIG. 6 is a perspective view of a second embodiment of the present invention, showing a support pole and radial holder arms in locking engagement with the second embodiment which has a locking feature to prevent accidental disengagement.
Figure 9:
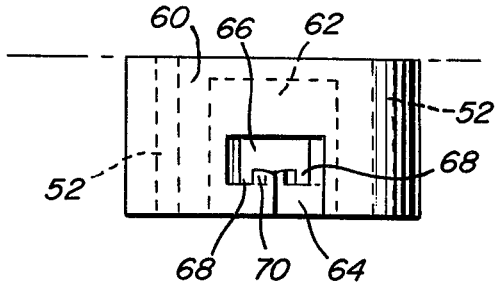
FIG. 9 is a side elevational view of the device of FIG. 6, showing internal structure in phantom, without the associated support pole and holder of FIG. 6.
Figure 7:
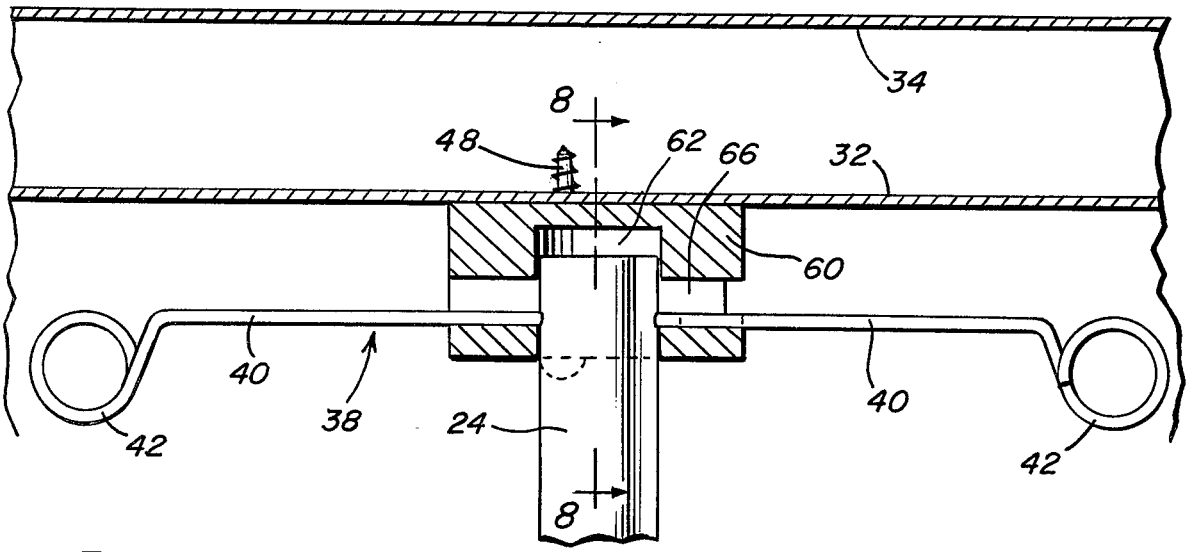
FIG. 7 is a sectional view of the device of FIG. 6, taken substantially upon a plane passing along section line 7—7 of FIG. 6.
Figure 8:
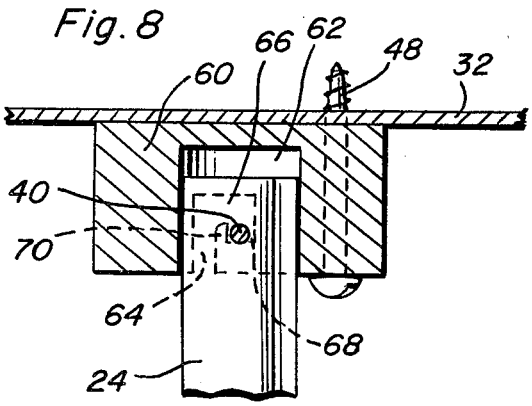
FIG. 8 is a perspective view of the device of FIG. 6, taken substantially upon a plane passing along section line 8—8 of FIG. 7.
Figure 10:
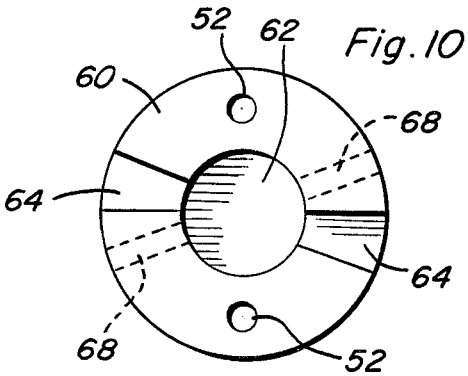
FIG. 10 is a bottom plan view of the device of FIG. 6, without the associated support pole and holder arms.

A second embodiment of the present invention is shown in FIG. 6, where anchoring device 60 has a locking feature to prevent accidental disengagement of support pole 24 and bottle holder 38 in the event of downward longitudinal motion of support pole 24, such as might occur if someone accidentally actuates the pole release when ambulance 20 is traversing rough or uneven roadways, particularly at high speed and in making turns. Furthermore, the locking feature of the second embodiment guards against accidental disengagement of mount 26 on support platform 22. While the second embodiment, anchoring device 60 is provided with recess 62 which bears a strong resemblance to recess 50 of the first embodiment of anchoring device 36, and device 60 is provided with diametric slot 64 for upward insertion of arms 40 in a manner similar to slot 50 for upward insertion of arms 40 in the first embodiment of device 36, the second embodiment further provides a bayonet slot arrangement which includes an undercut passage 66 for horizontal swinging movement of arms 40, followed by slight downward displacement into locking notches 68 which define retaining lips 70 constructed to minimize the possibility of dislodgement of bottle holder 38 from anchoring device 60 until the appropriate deliberate manipulative lifting, twisting and dropping action, ordinarily performed after a period of use, has been carried out. FIGS. 7 to 10 show other views of the second embodiment of the device, FIGS. 7 and 8 including support pole 24 in conjunction with bottle holder 38 associated with device 60.

Throughout the specification and claims, reference to the patient support means 22 ordinarily is intended to indicate a cot, although other equivalent articles, such as a stretcher or the like, are contemplated as well, including those which permit the patient to be transported in a sitting, as well as supine or prone position. Preferably, patient support means 22 is collapsible, although such a capability is not required for successful implementation of the invention.

Among the advantages of the present invention are the following. With support poles for intravenous bottle holders conventionally used, there is a need for an attendant to physically hold the support pole while the vehicle is in motion, or alternatively, it is necessary to transfer the intravenous bottle or bottles to a more stable form of holder prior to placing the vehicle in motion. With use of the present invention, valuable time is saved by obviating the necessity for such transfer, and additionally, the need for an attendant to manually support the pole is eliminated.

Either of the embodiments of the invention, namely device 36 or device 60 can be made from any material sufficiently rigid and durable to perform the intended function, such as, for example, any molded hard plastic, preferably a thermoset synthetic resin. The device can be cast, molded or poured into the final desired shape, or alternatively, the device can be manufactured by conventional shaping techniques from a blank disk-shaped stock material, such as by drilling of recess 54 or 62, drilling of holes 52, milling of slots 50 or 64, or the like.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An emergency vehicle means comprising:

a support platform;

a roof in fixed relation with said support platform;

patient support means disposed on said support platform;

a support pole secured to said patient support means and projecting upwardly therefrom, said support pole having an upper distal end projecting upwardly away from said patient support means towards said roof;

bottle holder means attached near said upper distal end of said support pole and having a pair of oppositely extending radial arms, each of said arms having a loop formed at the outward distal end thereof for holding one or more dependingly attached bottles; and anchoring means for removably attaching said support pole to said roof, for reducing swaying movement of said support pole and said bottle holder means and for substantially preventing rotation of said bottle holder means, said anchoring means comprising a disc-shaped plate having a central recess for receiving said upper distal end of said support pole, sad disc-shaped plate having a pair of mounting holes for fixed mounting thereof to an interior surface of said roof and a diametric slot for receiving said oppositely extending radial arms of said bottle holder means.

2. The improvement of claim 1 wherein said plate is further provided with symmetrical undercut passageways extending circumferentially from said slot to prevent rotation of said support pole and arms after insertion in said device.

3. The improvement of claim 2 wherein said undercut passageways are further provided with a locking notch to hold said arms in a locking relationship to said plate and prevent accidental disengagement thereof.

4. The improvement of claim 3 wherein a lip is provided adjacent said locking notch to facilitate said locking relationship.

5. The improvement of claim 1 wherein said plate is constructed of a thermoset synthetic resin molded with said recess, said slot, and said mounting holes.

6. The improvement of claim 1 wherein said plate is constructed by drilling of said recess and mounting holes, and milling of said slot.

7. In an emergency vehicle means having:

a support platform;

a roof in spaced, fixed relation with said support platform;

patient support means disposed on said support platform;

a support pole having a lower end secured to said patient support means and an upper distal end projecting upwardly away from said patient support means toward said roof; and a bottle holder having a pair of oppositely extending radial arms attached to said upper distal end of said support pole, each of said arms having attaching means for holding one or more dependingly attached bottles, anchoring means comprising:

a disk-shaped plate disposed on said roof and having a central recess facing downwardly toward said upper distal end of said support pole and adapted for removable insertion of said upper distal end of said support pole therein to prevent lateral swaying movement of said support pole and said bottle holder;

a downwardly facing diametric slot intersecting with said recess on said plate for insertion of said radial arms of said bottle holder; and means for securing said plate to said roof.

8. In an emergency vehicle means having:

a support platform;

a roof in spaced, fixed relation with said support platform;

patient support means disposed on said support platform;

a support pole having a lower end secured to said patient support means and an upper distal end projecting upwardly away from said patient support means toward said roof; and a bottle holder having a pair of oppositely extending radial arms attached to said upper distal end of said support pole, each of said arms having attaching means for holding one or more dependingly attached bottles, anchoring means comprising:

a disk-shaped plate disposed on said roof and having a central recess facing downwardly toward said upper distal end of said support pole and adapted for removable insertion of said upper distal end of said support pole therein to prevent lateral swaying movement of said support pole and said bottle holder;

a downwardly facing diametric slot intersecting with said recess on said plate for insertion of said radial arms of said bottle holder;

means for securing said plate to said roof;

symmetrical undercut passgeways extending circumferentially from said diametric slot of said disk for insertion of said radial arms by circumferential rotation thereof about said support pole to prevent further unwanted rotation of said bottle holder; and at least one retaining lip projecting upwardly into said undercut passageways adjacent said diametric slot to form a locking notch disposed between said retaining lip and a wall of said undercut passageways spaced circumferentially from said diametric slot, said locking notch being adapted for insertion of said radial arms by movement of said arms over said lip along said undercut passageways and for retaining said support pole and said radial arms in a desired position.

* * * * *